US010132492B2

(12) United States Patent
Nenmeni et al.

(10) Patent No.: US 10,132,492 B2
(45) Date of Patent: Nov. 20, 2018

(54) SYSTEM AND METHOD FOR DRUM LEVEL CONTROL IN A DRUM OF A HEAT RECOVERY STEAM GENERATOR

(71) Applicant: General Electric Company, Schenectady, NY (US)

(72) Inventors: Vijay Anand Raghavendran Nenmeni, Atlanta, GA (US); Kelvin Rafael Estrada, Norcross, GA (US); Wulang Edwien Chriswindarto, Kennesaw, GA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 696 days.

(21) Appl. No.: 14/044,771

(22) Filed: Oct. 2, 2013

(65) Prior Publication Data

US 2015/0090202 A1 Apr. 2, 2015

(51) Int. Cl.

| | |
|---|---|
| ***F22B 1/18*** | (2006.01) |
| ***F22B 35/00*** | (2006.01) |
| ***F22B 37/46*** | (2006.01) |
| ***F22B 37/78*** | (2006.01) |
| ***F22D 5/00*** | (2006.01) |

(52) U.S. Cl.

CPC ..... *F22B 1/1815* (2013.01); *F22B 35/007* (2013.01); *F22B 37/46* (2013.01); *F22B 37/78* (2013.01); *F22D 5/00* (2013.01); *Y10T 137/0374* (2015.04)

(58) Field of Classification Search

USPC ..... 137/11; 122/7 R, 451 S

See application file for complete search history.

(56) References Cited

U.S. PATENT DOCUMENTS

| | | | | |
|---|---|---|---|---|
| 3,955,358 | A | 5/1976 | Martz et al. | |
| 4,242,989 | A | 1/1981 | Chamberlain | |
| 4,336,825 | A | 6/1982 | Pion | |
| 4,353,204 | A | 10/1982 | Arakawa | |
| 4,457,266 | A | 7/1984 | La Spisa | |
| 4,619,224 | A | 10/1986 | Takita et al. | |
| 4,854,121 | A | 8/1989 | Arii et al. | |
| 5,148,775 | A | 9/1992 | Peet | |
| 5,555,849 | A * | 9/1996 | Wiechard | F22B 37/008 110/345 |
| 5,744,701 | A * | 4/1998 | Peterson | G01M 3/3245 73/40 |

(Continued)

*Primary Examiner* — Steven B McAllister
*Assistant Examiner* — John Bargero
(74) *Attorney, Agent, or Firm* — Fletcher Yoder, P.C.

(57) ABSTRACT

A system includes the HRSG having an economizer disposed along a fluid flow path, and a drum disposed along the fluid flow path downstream of the economizer. The HRSG also includes a drum level control module configured to modulate an amount of the fluid provided to the drum along the fluid flow path and a supplemental control module configured to control an amount of the fluid in a different manner than the drum level control module. The heat recovery steam generator also includes a drum level event controller configured to monitor a rate of change of a level of the fluid in the drum. If the rate of change is over a threshold value, a signal goes to the supplemental control. If the rate of change is less than or equal to the threshold value, the signal goes to the drum level control module.

7 Claims, 7 Drawing Sheets

(56) References Cited

U.S. PATENT DOCUMENTS

| | | | | |
|---|---|---|---|---|
| 5,771,846 | A * | 6/1998 | Ruchti | F22D 5/32 122/451 R |
| 6,520,122 | B2 | 2/2003 | Kemp et al. | |
| 7,053,341 | B2 | 5/2006 | Arora et al. | |
| 7,931,041 | B2 | 4/2011 | Mehendale et al. | |
| 8,887,747 | B2 * | 11/2014 | Kumar | F22D 5/30 122/448.1 |
| 2007/0084418 | A1 * | 4/2007 | Gurevich | F22B 1/1815 122/1 B |
| 2012/0031103 | A1 * | 2/2012 | Abe | F02C 6/18 60/776 |
| 2012/0036852 | A1 * | 2/2012 | Beveridge | F22G 5/12 60/653 |

* cited by examiner

SYSTEM AND METHOD FOR DRUM LEVEL CONTROL IN A DRUM OF A HEAT RECOVERY STEAM GENERATOR

BACKGROUND

The subject matter disclosed herein relates generally to heat recovery steam generators (HRSG) and, more specifically, to fluid flow into drums within the HRSG system.

An HRSG may be used as part of a combined cycle power plant, which includes both a gas turbine and a steam turbine. The gas turbine generates hot exhaust gases, which are used by the HRSG to generate steam to drive the steam turbine. The HRSG may include a number of drums to facilitate the heat exchange between the exhaust gas and water. Unfortunately, heating within each drum may create steam bubbles that can cause shrinking and swelling conditions to occur within the drum. Shrinking may be caused by an increase in the feed water supplied to the drum, which lowers the temperature within the drum and can cause steam bubbles to collapse. Collapsing bubbles in turn causes a drop in fluid level even though feed water is being added to the drum. Shrinking may also be caused when there is a sudden decrease in the amount of steam drawn from the drum which results in a sudden increase in pressure within the drum. Swelling conditions include a reversal of the shrinking conditions (i.e., a decrease in the feed water supply or a sudden increase in the amount of steam drawn from the drum) which results in a decrease in pressure within the drum. Swelling conditions may cause an increase in the number and size of the bubbles within the fluid in the drum, which increases the apparent fluid level. Shrinking and swelling conditions can potentially cause plant down time when fluid levels rise too high or drop too low.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a heat recovery steam generator (HRSG) having an economizer disposed along a fluid flow path, and a drum disposed along the fluid flow path downstream of the economizer The drum is configured to contain and heat a fluid. The heat recovery steam generator also includes a drum level control module configured to modulate an amount of the fluid provided to the drum along the fluid flow path and a supplemental control module configured to control an amount of the fluid provided to the drum along the fluid flow path in a different manner than the drum level control module. The heat recovery steam generator also includes a drum level event controller configured to monitor a rate of change of a level of the fluid in the drum. If the rate of change is over a threshold value, then the drum level event controller is configured to send a signal to the supplemental control to modulate the amount of fluid provided to the drum. If the rate of change is less than or equal to the threshold value, then the drum level event controller is configured to send the signal to the drum level control module to modulate the amount of the fluid provided to the drum.

In a second embodiment, a method includes receiving, at a processor, a level rate of change of a fluid within a drum of a heat recovery steam generator. The method also includes determining, via the processor, whether the rate of change exceeds a threshold value. If the rate of change exceeds the threshold value, the method includes sending a signal to a supplemental control module to modulate an amount of the fluid provided to the drum along a fluid flow path. If the rate of change does not exceed the threshold value, the method includes sending the signal to a drum level control module to modulate an amount of the fluid provided to the drum along the fluid flow path. The supplemental control module and the drum level control module modulate the amount of the fluid provided to the drum differently.

In a third embodiment, a system includes a drum level event controller configured to receive a drum level rate of change of a fluid within a drum of a heat recovery steam generator and determine whether the rate of change exceeds a threshold value. If the rate of change exceeds the threshold value, the drum level controller is configured to respond by sending a signal to a supplemental control module to modulate an amount of the fluid provided to the drum along a fluid flow path. If the rate of change does not exceed the threshold value, the drum level controller is configured to respond by sending the signal to a drum level control module to modulate an amount of the fluid provided to the drum along the fluid flow path. The supplemental control module and the drum level control module modulate the amount of the fluid provided to the drum differently.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
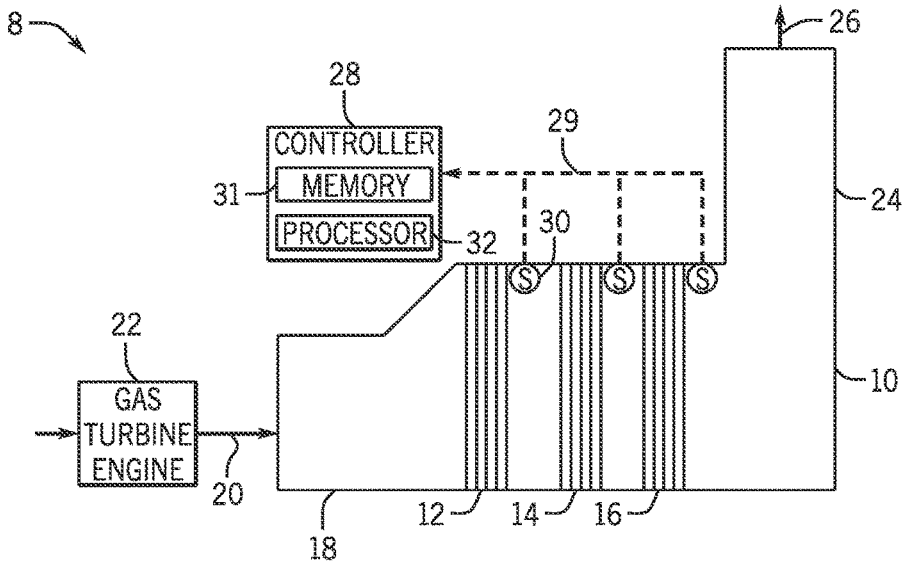
FIG. 1 is a schematic diagram of an embodiment of a Heat Recovery Steam Generator.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

The disclosed embodiments include systems and methods for more accurately responding to changes in the level of a drum (e.g., boiler drums, high pressure drums, intermediate pressure drums, etc.), such as a boiler drum of an HRSG system. As mentioned above, shrinking and swelling conditions may create an apparent fluid level within a drum that is not consistent with proper operation of the HRSG system 10. In response to these apparent fluid levels, without the disclosed embodiments, valve controllers may respond with an undesirable increase or decrease in the fluid flow. For example, during a shrinking condition, the apparent fluid level decreases due to collapsing steam bubbles, as explained above. A valve controller may, without the disclosed embodiments, respond to the apparent decrease in fluid level by increasing the amount of feed water provided to the drum. This increase in feed water may cause a rapid decrease in the temperature and pressure within the drum, which may cause undesirable operation of the plant. As another example, during swelling, steam bubbles may increase the apparent fluid level within the drum. The valve controller, without the disclosed embodiments, may respond with a decrease in the fluid flow provided to the drum. This situation may also cause rapid fluctuation in the temperature and pressure within the drum, which may also trigger a trip in the system 8, or part of the system 8. Without a pressure sensor within the drum, it is difficult to determine the actual fluid level and/or the mass of fluid within the drum. Therefore, an additional control that senses the rate of change of the drum level (e.g., surface level of the fluid within the drum) may be employed to decrease rapid fluctuations in the drum level caused by shrinking, swelling, or similar condition.

The additional control senses the rate of change of the drum level and sends signals to control valves and/or fluid flow paths that may convey fluid to the drum at different rates. In the embodiments below, two fluid flow paths are described that may convey fluid to the drum based on a controller sending a signal to one of two control modules. In other embodiments, more control modules may be employed. The two control modules control fluid flow along two flow paths. A first fluid flow path flows through an economizer and a first valve while a second fluid flow path may flow around the economizer to the drum, around the economizer back to the first fluid flow path, or around the valve to the drum or back to the first fluid flow path.

FIG. 1 is a block diagram of an embodiment of a system 8 that includes an HRSG 10 with one or more HRSG sections (e.g. evaporator sections), each including a natural or forced circulation evaporator. As shown in FIG. 1, the HRSG 10 includes a high-pressure (HP) evaporator section 12, an intermediate-pressure (IP) evaporator section 14, and a low-pressure (LP) evaporator section 16. The HP evaporator section 12 generates HP steam, the IP evaporator section 14 generates IP steam, and the LP evaporator section 16 generates low-pressure steam. Each section 12, 14, and 16 is a heat exchanger that generates steam by transferring heat from the heated exhaust gas 20 to water or steam. As discussed in detail below, each of the sections 12, 14, and 16 may include a drum, a drum level control module, and a supplemental control module. The combination of the drum level control module and the supplemental control module may reduce the number of plant trips that occur during transients. The HP section 12 is located near an inlet section 18 of the HRSG 10. As the temperature of heated exhaust gas 20 from a gas turbine engine 22 may be highest near the HP section 12, the HP section 12 generates high-pressure steam. In other words, the high temperature of the heated exhaust gas 20 near the HP section 12 provides sufficient heat to produce the high-pressure steam. The heated exhaust gas 20 from the gas turbine engine 22 enters the HRSG 10 in the inlet section 18. After the heated exhaust gas passes through the HP section 12, the IP section 14, and the LP section 16, a cooled exhaust gas 26 exits HRSG 10 from an HRSG stack 24. Thus, the cooled exhaust gas 26 may exit from the HRSG stack 24 into the atmosphere. In other embodiments, the IP section 14 may be omitted, additional pressure sections (e.g., 1 to 10 extra sections) may be added, or the HRSG 10 may be configured as a single-pressure system.

In certain embodiments, the system 8 may include a controller 28 having memory 31 including non-transitory readable media storing code or instructions executed by a processor 32. The controller 28 may include one or more control modules (or controllers) as described in detail below. The control modules may be used to control certain aspects of the system 8. For example, the controller 28 may send or receive signals 29 (e.g., feedback data) from one or more sensors 30 disposed in the HRSG 10. In certain embodiments, the sensors 30 may be disposed in one or more of the HP section 12, the IP section 14, or in the LP section 16. The controller 28 communicating with the sensors 30 may also control other sections of the system 8 or may be part of a larger network of controllers with sensors 30 within the gas turbine 22, the inlet section 18, the HRSG stack 24, or any combination thereof. The sensors 30 may measure various conditions or parameters of the HRSG 10, such as, but not limited to, a level of fluid within a drum, a temperature, a flow rate, a pressure, or any combination thereof. More specifically, the controller 28 may use the information received from the sensors 30 to generate and send signals 29 (e.g., control signals) to one or more components of the system 8.

Figure 2:
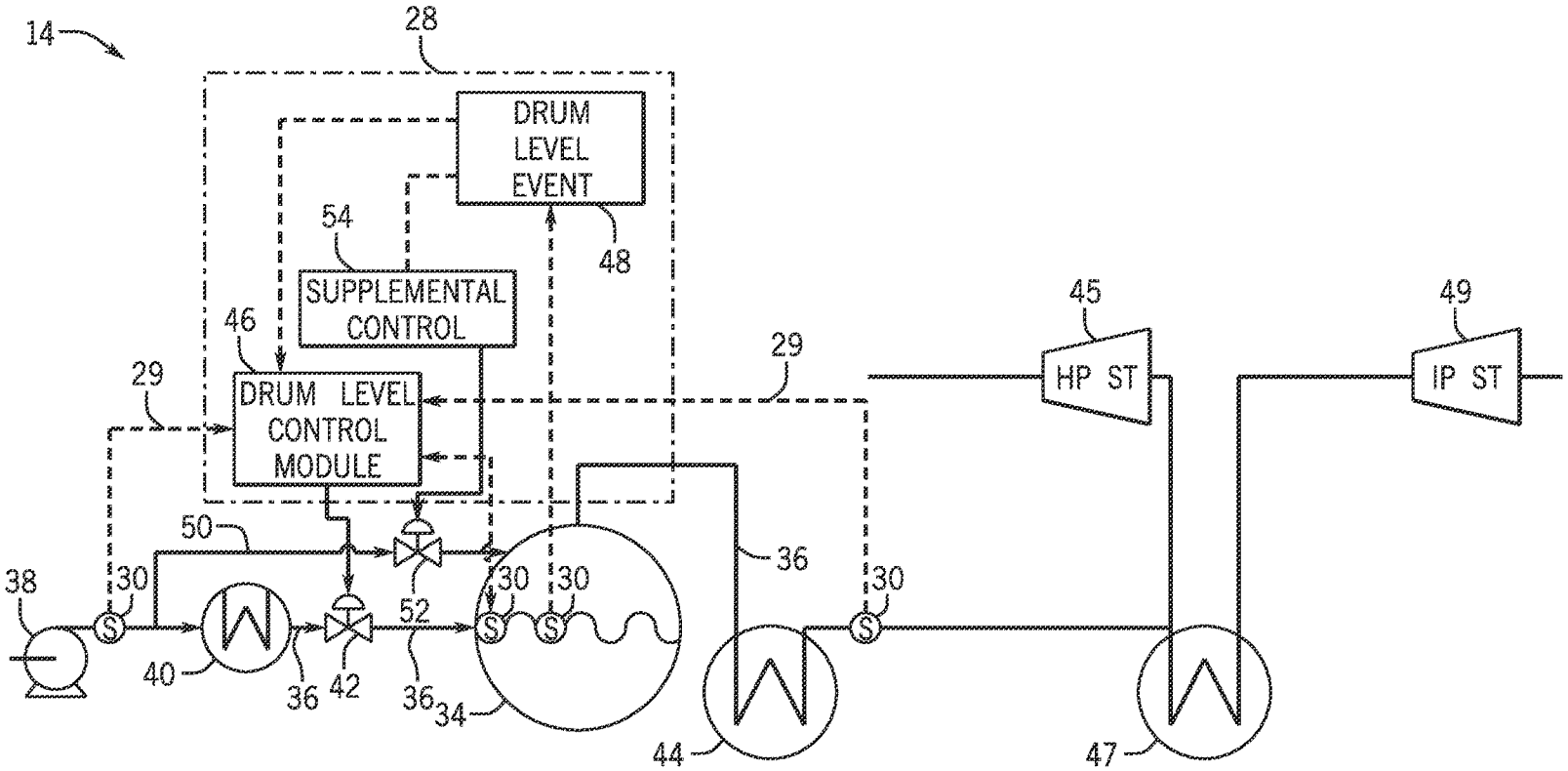
FIG. 2 is a schematic diagram of an embodiment of an intermediate pressure (IP) section of the HRSG of FIG. 1 having a first fluid flow path through an economizer and a second fluid flow path that bypasses the economizer.

FIG. 2 is a schematic diagram of an embodiment of the IP section 14 of the HRSG 10 having two fluid flow paths according to certain embodiments. The illustrated embodiment and all embodiments described below are not limited to the IP section 14 and may occur in any section or drum. A primary or first fluid flow path 36 may include an IP feed water pump 38 that pumps fluid to the IP economizer 40. The fluid may come from the LP section 16 of the HRSG 10, or from another source within the system 8, or from a source external to the system 8. The economizer 38 adjusts or maintains the temperature of the fluid in order to improve the efficiency of the IP evaporator section 14. After the fluid leaves the economizer 38, it flows downstream along the first fluid flow path 36 to the IP drum 34. The first fluid flow path 36 may include an IP feed water control valve 42 that may be located between the economizer 38 and the IP drum 34, as illustrated. The IP feed water control valve 42 may be utilized to adjust the flow through the first fluid flow path 36. The IP evaporator section 14 is used to heat fluid into steam or other gas, some of which exists as bubbles within the fluid as explained above. The steam, gas, or some of the fluid, may exit the IP drum 34 further downstream along the fluid flow path 36 to an IP superheater 44. From the superheater 44, the fluid, gas, or steam may proceed downstream to other sections of the HRSG 10. For example, the steam from the IP superheater 44 may combine with steam from the HP steam turbine 45 to flow into the reheat superheater 47.

The IP section 14 (e.g., heat exchangers, drum, valves, pumps, sensors, actuators) connects to the controller 28 at several connections throughout the IP section 14. The controller 28 includes a drum level control module 46 (e.g., drum level controller) that is connected to the IP feed water control valve 42. The drum level control module 46 adjusts the control valve 42 in order to control the amount of fluid flow through the control valve 42. The drum level control module 46 may adjust the fluid flow based on a user input or based on feedback from the sensors 30 within the first fluid flow path 36 and/or within the IP drum 34. The IP drum 34 may also contain a sensor 30 that monitors the fluid level within the IP drum 34, the rate of change of the fluid level within the IP drum 34, or other characteristics of the IP drum 34. The sensors 30 communicate with a drum level event controller 48 so that the system 8 may react appropriately to maintain proper fluid level.

Rather than using a single flow (i.e., the first fluid flow 36 controlled by the drum level control module 46), the controller 28 in the illustrated embodiment uses a second fluid flow path 50 whereby feed water may flow from one part of the IP section 14 to another part. As illustrated in FIG. 2, the second fluid flow path 50 may connect to the first fluid flow path 36 at a connection upstream of the economizer 40. That is, the second fluid flow path 50 may convey (e.g., bypass or re-route) fluid from the first fluid flow path 36 before it enters the economizer 40. Also as illustrated, the second fluid flow path 50 includes a supplemental control valve 52 that may adjust the fluid flow rate through the second fluid flow path 50. The second fluid flow path 50 ends delivering the fluid into the IP drum 34. The supplemental control valve 52 is connected to a supplemental control module 54 (e.g., supplemental controller) that controls the supplemental control valve 52. The supplemental control module 54 may respond to signals from a user or may respond to signals received from other components of the system 8. In the illustrated embodiment, for example, the drum level event module 48 sends a signal to the supplemental control module 54 to indicate that the supplemental control module 54 should activate the supplemental control valve 52. The supplemental control valve 52 and the supplemental control module 54 are thus configured to respond differently during shrinking and swelling conditions, for example. That is, when the drum level event module 48 registers a shrinking condition, it signals the supplemental control module 54 which subsequently provides less fluid to the IP drum 34, reducing the potential consequences of the shrinking condition.

In certain embodiments, the drum level event controller 48 sends a signal or signals to the drum level control module 46, the supplemental control module 54, or both based on the rate of change sensed by the sensors 30 of the fluid level within the IP drum 34. For example, if sensors 30 indicate that the rate of change of the fluid level in the IP drum 34 is over a threshold value, then the drum level event controller 48 sends a signal to the supplemental control module 54 to provide extra fluid flow through the supplemental control valve 52. On the other hand, if sensors indicate that the rate of change is less than the threshold value, then the drum level event controller 48 sends the signal to the drum level control module 46 which executes a normal drum level control of the fluid through the control valve 42. The threshold value is determined by the difference between the detected rate of change via sensors, and the normal rate of change expected for the current operation. For example, in one embodiment, the threshold value of the rate of change is two times the normal rate of change, in which case the drum level event controller 48 sends the signal to the supplemental control module 54. In other embodiments, the threshold value is 1.5, 2.5, 3, 3.5, or other multiples of the normal rate of change. In still other embodiments, the drum level event controller 48 may respond to multiple threshold values that determine different types of signals that are sent to both the supplemental control module 54 and the drum level control module 46. One type of signal may initiate the supplemental control module 54 to open the supplemental control valve 52 to 20 percent of maximum flow. Another rate of change detected by the sensors 30 may cause the drum level control module 46 to send a signal to the supplemental control module 54 to open the supplemental control valve 52 to 50 percent, or 60 percent. Furthermore, the supplemental control module 54 may have a default condition such that the valve 52 is open to an intermediate flow level. In such a condition, responding to the signal from the drum level event controller 48 may include lowering the flow level (e.g., a default flow level is 50 percent open and response to the signal from the drum level event controller 48 lowers the flow to 25 percent). Thus, the amount of flow through the supplemental control valve 52 may be any percentage based on a determination by the drum level event controller 48. In the illustrated embodiment, the supplemental control module 54 delivers an amount of fluid along the second fluid flow path 50 that is different than the amount of fluid delivered along the first fluid flow path 36. This enables the controller 28 to respond to shrink and swell conditions without causing a plant trip.

Figure 3:
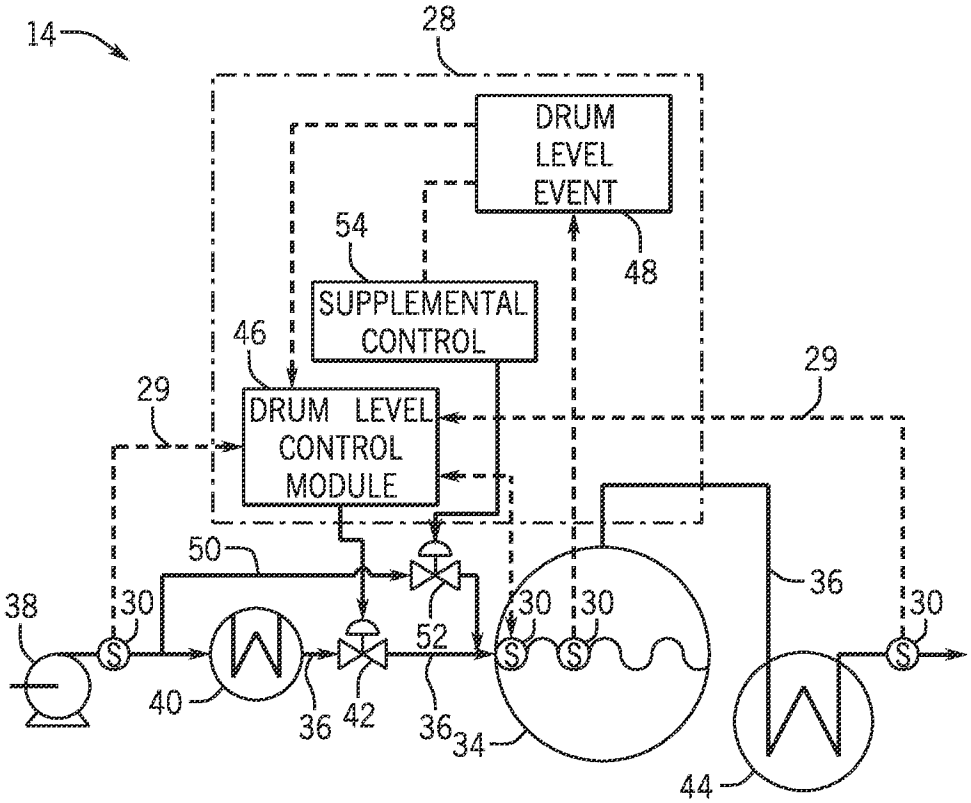
FIG. 3 is a schematic diagram of an embodiment of an intermediate pressure (IP) section of the HRSG of FIG. 1 having a first fluid flow path through an economizer and a second fluid flow path that bypasses the economizer.

FIG. 3 is a schematic diagram of an embodiment of the IP section 14 of the HRSG having two fluid flow paths according to certain embodiments. The second fluid flow path 50 is coupled to the first fluid flow path 36 upstream of the economizer 40, similar to FIG. 2, and then connects with the first fluid flow path 36 again between the economizer 40 and the IP drum 34. Again, the second fluid flow path 50 bypasses the economizer 40, which enables the fluid that flows through the second fluid flow path 50 to have attributes, such as temperature, that are different from the fluid flowing through the control valve 42 of the first fluid flow path 36. Connecting to the first fluid flow path 36 rather than directly to the drum 34 enables an easier connection and increases the structural integrity of the drum 34. That is, in some embodiments it is better to minimize connections and/or openings into the drum 34. In those embodiments, the second fluid flow path 50 may employ a flow path-to-flow path configuration shown in FIG. 3. The drum level event controller 48 sends signals to the drum level control module 46 and supplemental control module 54 based on the rate of change of the fluid level indicated by the sensors 30 within the IP drum 34. The signals may also be based on some other event.

Figure 4:
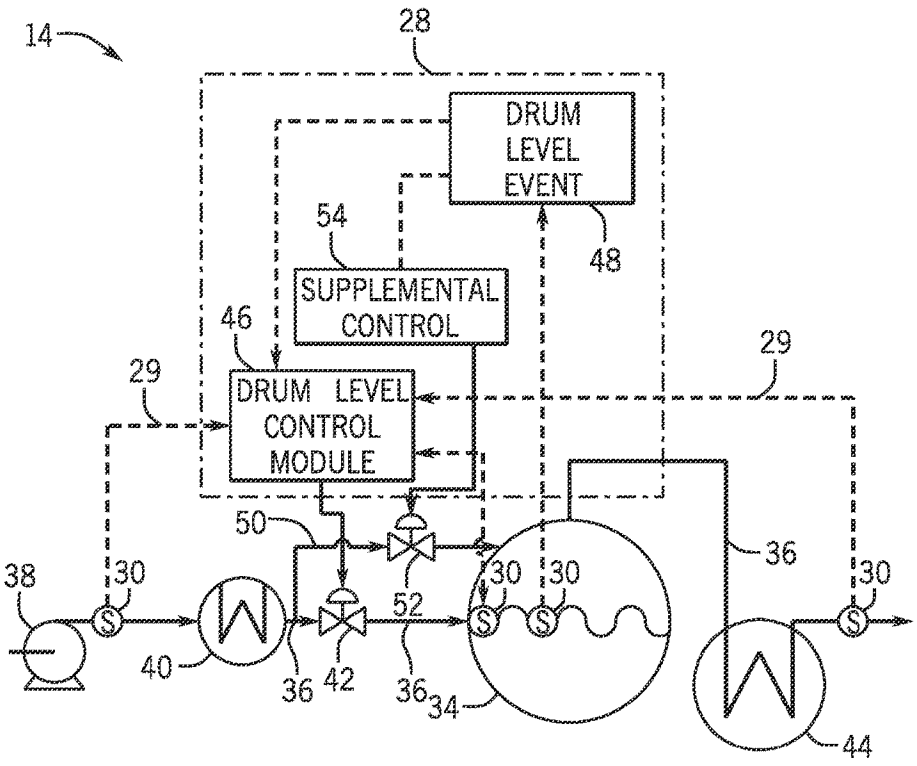
FIG. 4 is a schematic diagram of an embodiment of an intermediate pressure (IP) section of the HRSG of FIG. 1 having a first fluid flow path through an economizer and a control valve, and a second fluid flow path that bypasses the control valve.

FIG. 4 is a schematic diagram of an embodiment of the IP section 14 of the HRSG 10 having two fluid flow paths according to certain embodiments. The second fluid flow path 50 is coupled to the first fluid flow path 36 downstream of the economizer 40, and then delivers the fluid to the IP drum 34. Each of the paths controlled by the drum level event controller 48 is able to adjust the amount of fluid supplied to the IP drum 34 that has been heated by the economizer 40. The first fluid flow path 36 provides a default amount of fluid heated by the economizer 40 while the second fluid flow path 50 provides a supplemental amount of heated fluid (i.e., heated by the economizer 40) directly to the drum 34. This enables the controller 28 to react to shrinking and swelling conditions based only on the amount of flow. This may simplify any calculations done by the drum level event controller 48. For example, the drum level event controller 48 may receive an indication that the rate of change of the drum level is some factor higher or lower than normal. Based on that factor, the drum level event controller 48 may calculate the degree to instruct the supplemental control module 54 to increase or decrease the flow. The second fluid flow path 50 illustrated in FIG. 4 may decrease the amount of calculation done by the drum level event controller 48 due to the removal of temperature differences between the first fluid flow path 36 and the second fluid flow path 50.

Figure 5:
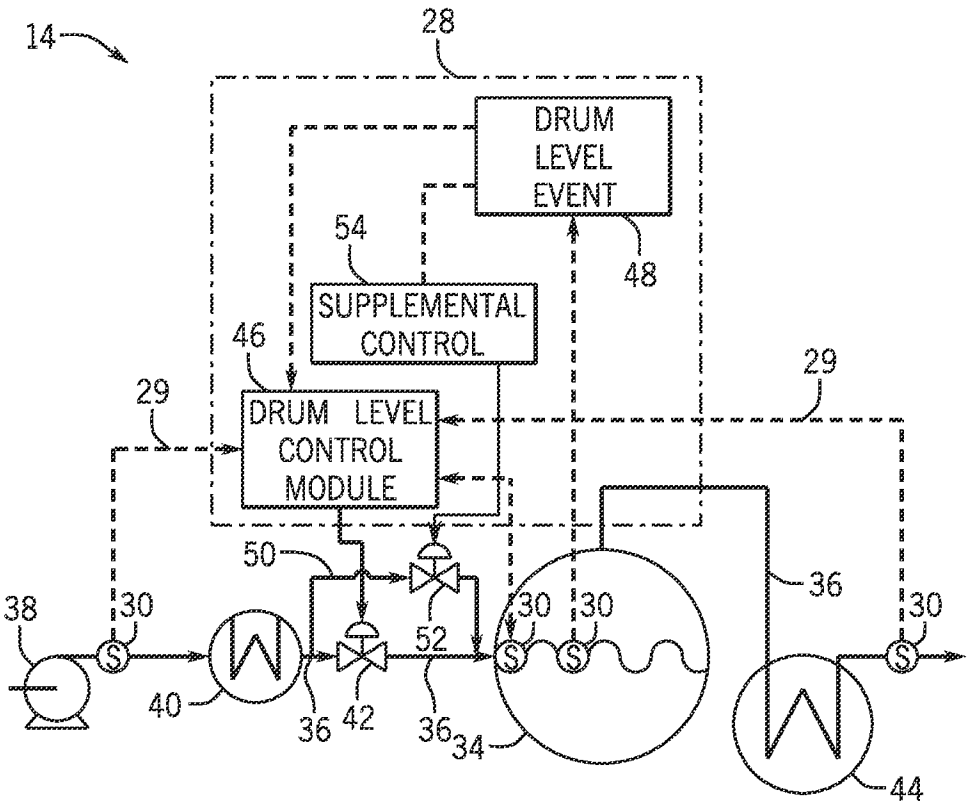
FIG. 5 is a schematic diagram of an embodiment of an intermediate pressure (IP) section of the HRSG of FIG. 1 having a first fluid flow path through an economizer and a control valve, and a second fluid flow path that bypasses the control valve.

FIG. 5 is a schematic diagram of an embodiment of the IP section 14 of the HRSG 10 having two fluid flow paths according to certain embodiments. The second fluid flow path 50 is couple to the first fluid flow path 36 downstream of the economizer 40 and then delivers the fluid to the first fluid flow path 36 downstream of the control valve 42 and upstream of the IP drum 34. The second fluid flow path 50 illustrated in FIG. 5 also adjusts the amount of fluid supplied to the IP drum 34 that has been heated by the economizer 40. This allows the first fluid flow path 36 to continue to operate under normal procedure while the second fluid flow path 50 provides supplemental flow in the event a swelling condition wherein the rate of change of the fluid level indicated by the sensors 30 is over the threshold value. In the event of the drum level event controller 48 receiving such an indication, it sends a signal to the supplemental control module 54 to increase flow through the second fluid flow path 50. The signals may also be based on some other event.

Figure 6:
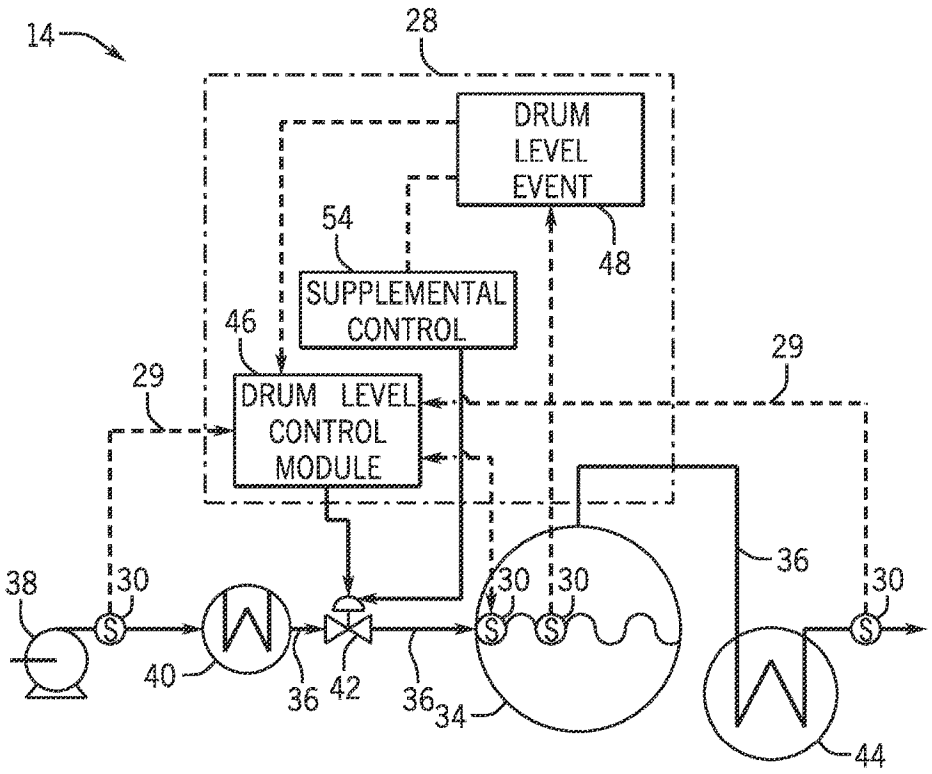
FIG. 6 is a schematic diagram of an embodiment an intermediate pressure (IP) section of the HRSG of FIG. 1 having a fluid flow path through an economizer and a control valve.

FIG. 6 is a schematic diagram of an embodiment of the IP section 14 of the HRSG 10 having two fluid flow paths according to certain embodiments. The supplemental control module 54 does not connect to a second fluid flow path but instead connects directly to the control valve 42. Thus, the control valve 42 is connected to both the drum level control module 46 and the supplemental control module 54. The control valve 42 is thus controlled by different modules 46, 54 based on where the drum level event controller 48 sends the signal. The drum level event controller 48 sends signals to the drum level control module 46 and supplemental control module 54 based on the rate of change of the fluid level within the IP drum 34. The signals may also be based on some other event.

Figure 7:
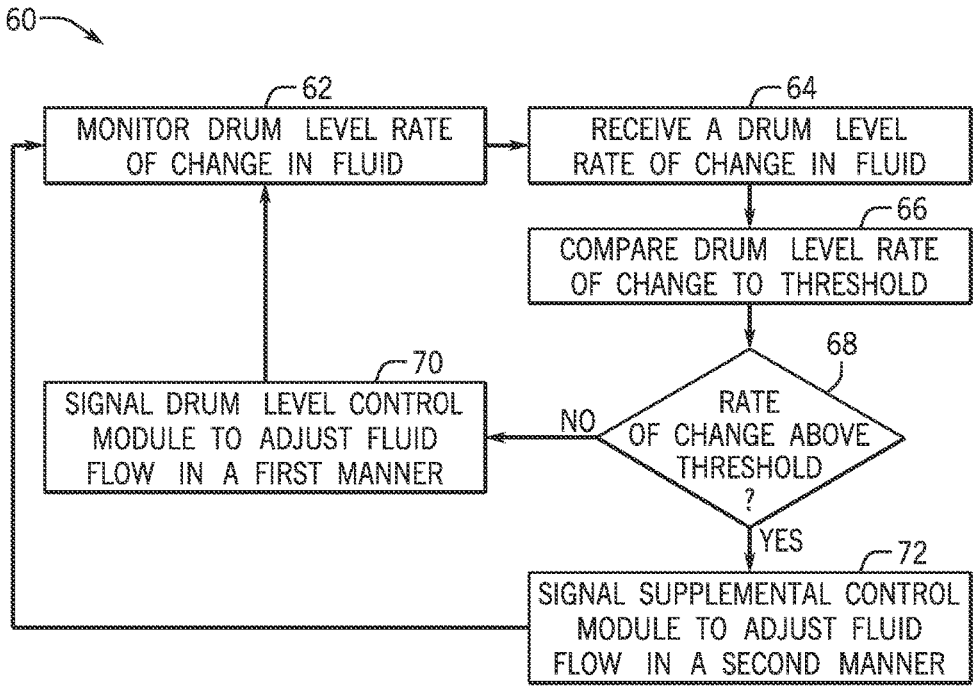
FIG. 7 is a flow chart of an embodiment of a method to monitor and control a fluid level of a drum.

FIG. 7 is a flow chart of an embodiment of a computer-implemented method 60 to monitor and control the fluid level of a drum. The method 60 may be performed, for example, by the controller 28 described above and could be code stored in memory 31 and executed by processor 32. At block 62, the controller 28, or other device or apparatus, begins the method 60 by monitoring the drum level rate of change in fluid via one or more sensors 30. As described above, the fluid level within the drum (e.g., the IP drum 34) changes due to fluid being added from the first fluid flow path 36, the second fluid flow path 50, or other source, and by fluid being lost downstream to the rest of the system 8. At block 64, the rate of change of the fluid level is received by the controller 28. The rate of change in fluid level is then compared, at block 66, to a threshold level by the controller 28. The threshold level may be two times the normal rate of change of the fluid, or may be three, four, five, or more times the normal rate of change within the drum (e.g., IP drum 34). At block 68, the method responds differently whether the rate of change was above or below the threshold. If the rate of change was not above (e.g., at or below) the threshold, the method, at block 70, signals a drum level control module (e.g., the drum level control module 46) to adjust fluid flow in a first manner, such as continuing fluid flow through the IP feed water control valve 42. If the rate of change was above the threshold, the method, at block 72, signals a supplemental control module (e.g., the supplemental control module 54) to adjust fluid flow in a second manner, such as switching off the IP feed water control valve 42 and switching on the supplemental control valve 52, or opening or closing the supplemental control valve 52. In either case, once the fluid flow has been adjusted (i.e., block 70 or block 72), the method repeats by starting over at block 62.

Technical effects of the disclosed embodiments include controlling the fluid level within a drum by adjusting the mechanisms for introducing fluid into the drum. The controller 28 monitors the rate of change within the drum (e.g., IP drum 34) and sends a signal to different modules depending on that rate. If the rate of change of the fluid level is over the threshold value, then the drum level event controller 48 within the controller 28 may send the signal to the supplemental control module 54. This may alleviate the effects of shrinking and swelling conditions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

a heat recovery steam generator (HRSG), comprising:

a fluid flow path comprising a first fluid flow path, a second fluid flow path, a feed water control valve disposed along the first fluid flow path, and a supplemental feed water control valve disposed along the second fluid flow path;

an economizer disposed along the first fluid flow path;

a drum disposed along the fluid flow path downstream of the economizer and configured to contain a fluid;

at least one sensor disposed within the drum, wherein the at least one sensor is configured to measure a rate of change of a level of the fluid in the drum;

a drum level controller configured to modulate an amount of the fluid provided to the drum along the fluid flow path;

a supplemental controller configured to control an amount of the fluid provided to the drum along the fluid flow path in a different manner than the drum level controller; and a drum level event controller configured to receive a signal representative of the rate of change of the level of the fluid in the drum from the at least one sensor and to monitor the rate of change of the level of the fluid in the drum by comparing the rate of change of the level of the fluid to a threshold value to determine if the rate of change is over or less than or equal to the threshold value, wherein if the rate of change is over a threshold value, then the drum level event controller is configured to send a signal to the supplemental controller to modulate the amount of fluid provided to the drum, and if the rate of change is less than or equal to the threshold value, then the drum level event controller is configured to send a different signal to the drum level controller to modulate the amount of the fluid provided to the drum;

wherein the supplemental controller is coupled to and configured to adjust the supplemental feed water control valve upon receiving the signal and the drum level control controller is coupled to and configured to adjust the feed water control valve upon receiving the different signal, and wherein the supplemental controller and the drum level controller provide different amounts of fluid to the drum or provide the fluid at different rates to the drum in response to the signal and the different signal, respectively.

2. The system of claim 1, wherein the second fluid flow path is configured to connect at a first connection point upstream of the economizer and at a second connection point at the drum.

3. The system of claim 1, wherein the second fluid flow path is configured to connect at a first connection point along the first fluid flow path upstream of the economizer and at a second connection point along the first fluid flow path downstream of the economizer and upstream of the drum.

4. The system of claim 1, wherein the second fluid flow path is configured to connect at a first connection point along the first fluid flow path downstream of the economizer and at a second connection point at the drum.

5. The system of claim 1, wherein the second fluid flow path is configured to connect at a first connection point along the first fluid flow path downstream of the economizer and at a second connection point along the first fluid flow path downstream of both the first connection point and the economizer and upstream of the drum.

6. The system of claim 1, wherein the threshold value is over a normal level rate of change.

7. The system of claim 1, wherein the drum comprises a low pressure boiler drum, an intermediate pressure boiler drum, or a high pressure boiler drum.

* * * * *